United States Patent [19]

Groen et al.

[11] 4,235,193

[45] Nov. 25, 1980

[54] MAGNETIC BRUSH APPARATUS FOR DEVELOPING CHARGE IMAGES

[75] Inventors: Otto M. Groen, Grubbenvorst; Andreas M. G. Bongers, Ittervoort; Bernard J. E. Peeters, Helden; Peter H. M. Lammers, Grubbenvorst, all of Netherlands

[73] Assignee: Océ-van der Grinten N.V., Venlo, Netherlands

[21] Appl. No.: 933,111

[22] Filed: Aug. 11, 1978

[30] Foreign Application Priority Data

Aug. 22, 1977 [NL] Netherlands ..... 7709230

[51] Int. Cl.[3] ..... G03G 15/09

[52] U.S. Cl. ..... 118/658; 118/602; 118/612

[58] Field of Search ..... 118/658, 602, 612, 656, 118/657

[56] References Cited

U.S. PATENT DOCUMENTS 4,131,357 12/1978 Forbes ..... 118/658 X

*Primary Examiner*—Bernard D. Pianalto

*Attorney, Agent, or Firm*—Albert C. Johnston

[57] ABSTRACT

Charge images on a moving substrate such as a photoconductive belt surface are developed by being passed over two magnetic developing rollers in succession, which include nonmagnetizable cylinders rotatable in opposite directions about stationary magnet systems and are spaced apart outside each other's zone of influence in the upper region of a trough-shaped reservoir. The reservoir has oppositely sloped side walls converging to a bottom for holding a supply of developing powder, from which powder is supplied into a zone between the developing rollers for attraction to their surfaces by at least one magnetic transfer roller located between them and the bottom. Powder passed on the developing roller beyond the image substrate is returned so as to mix with the supply powder by being guided into and falling along channels formed on the sloped side walls by opposite groups of parallelly erect partitions which on one sloped wall lie at acute angles to the roller axes and on the other, viewed in the same direction, lie at obtuse angles to the roller axes.

9 Claims, 2 Drawing Figures

MAGNETIC BRUSH APPARATUS FOR DEVELOPING CHARGE IMAGES

This invention relates to an apparatus of the magnetic brush type for the development of charge images on a moving substrate.

The invention provides improvements over known magnetic brush developing apparatus of a kind in which a trough-shaped reservoir having two long, opposite sloping walls lying in planes intersecting the bottom of the reservoir is provided in its upper region with developing rollers arranged parallel to the sloping walls, each of which rollers comprises a non-magnetizable cylinder rotatable about stationary magnets installed inside the cylinder. Such known developing apparatus also comprises means between the bottom of the reservoir and the developing rollers for transporting developing powder from the reservoir to the developing rollers, and means for mixing powder returned from these rollers with developing powder in the reservoir.

A magnetic brush suitable for developing charge images can be formed on the developing rollers of such an apparatus by the use of a binary developing powder consisting of a magnetizable powder mixed with a toner powder, or, alternatively, by a "one-component" developing powder in which magnetizable material is incorporated in the toner particles.

In a simple form of known developing apparatus, a single developing roller is partially immersed in developing powder in the reservoir, or is mounted above the stock of developing powder and supplied with developing powder by a transport screw or a magnetic transport roller similar to the developing roller. Such an apparatus employing a magnetic transport roller is described in U.S. Pat. No. 3,654,902.

A single developing roller which moves at the side of the charge image in the same direction as the charge image movement serves excellently in copying apparatus having a low copying speed. With high copying speeds of about 10 meters per minute or more, however, a developing roller so following the image support transfers too little developing powder to the charge image, so that copies having too low an optical density are obtained. This consequence is accentuated when, as for copying drawings, it is desired to form an image with an edge effect for improving contour sharpness. Such an edge effect can be achieved in the use of a binary developing powder, for instance, by increasing the specific resistance of the magnetizable powder component, but as a result of this the developing speed and consequently the optical density of the copies obtained decreases. A counterrunning developing roller, i.e., one which moves in the direction opposite to the movement of the charge image, has this disadvantage to a much lesser degree, but such a roller gives poor development of half tones. Moreover, in the use of a binary developing powder a counterrunning roller transfers to the charge image not only toner but also a part of the magnetizable material.

A developing apparatus avoiding disadvantages mentioned above is described in British patent specification No. 1,373,010. This known apparatus comprises four developing rollers running in the same direction as the charge image. The developing powder is supplied to the first developing roller with the aid of a paddle wheel and is transported in a continuous stream over the four developing rollers, each of which is arranged within another's sphere of influence. By repeated contact of the powder stream with the charge image a relatively long time of contact is assured for the production of copies having a high optical density even at high copying speed. After passing the fourth developing roller the unused remainder of the developing powder falls into a mixing device via a scraper. This mixing device comprises a first row of tubular channels arranged parallel to each other and a second row of parallel channels which are fixed to and extend across the channels of the first row, with all these channels sloped relative to the direction of free fall of the developing powder so that the developing powder is always split up into separate streams which arrive at different locations in the reservoir.

The developing apparatus of the said British patent specification, however, also has disadvantages. The four magnetic brushes on the four developing rollers form a surface imposing a very considerable amount of friction between the substrate carrying the charge images and the developing powder. As a result of this friction, the duration of satisfactory service of both the substrate and the developing powder is decreased. Further, the apparatus with four developing rollers is structurally less attractive than other apparatus, on the one hand because of the space it occupies and the large engaged surface area of the substrate, and on the other hand because the construction of the multi-channeled mixing device is complicated. Moreover, such apparatus is only suitable for the development of charge images on a sloping substrate, and the paddle wheel causes extra friction forces in the developing powder, so that, especially with binary developing powders, the particles of the magnetizable powder component, which is not consumed but is reused again and again, undergo ageing that requires them to be refreshed more frequently.

The present invention provides a developing apparatus which has the favorable properties of the developing apparatus of British patent specification No. 1,373,010 without the above-noted disadvantages of that apparatus.

The developing apparatus according to the invention corresponds in general to the kind of known apparatus described at the outset hereof, but it provides improvements thereover in that:

(a) the apparatus comprises two developing rollers which are arranged outside each other's sphere of influence, and the cylinders of these developing rollers have opposite directions of rotation so that their respective surfaces move away from each other at their side directed toward the substrate;

(b) at least one rotatable, non-magnetizable cylinder having stationary magnets installed inside it is arranged parallel to the developing rollers between them and the bottom of the reservoir for transporting developing powder to and between the developing rollers; and (c) the mixing of powder returned from the developing rollers with developing powder in the reservoir is effected by groups of parallelly erect partitions which are fixed to the opposite sloping walls of the reservoir so that the partitions on one sloping wall lie in planes inclined at an acute angle to the axes of the developing rollers and the partitions on the other sloping wall, viewed in the same direction, lie in planes inclined at an obtuse angle to the axes of the developing rollers. Such an arrangement for transporting, applying and re-mixing the developing powder has been found to be extremely effective and to cause a minimum of detrimental friction in the powder.

In the use of the present developing apparatus, a charge image is developed first with toner from the magnetic brush on a counterrunning developing roller and subsequently with toner from the magnetic brush on a following developing roller. In this way, on the one hand a high optical density and on the other hand an optimal development of halftones is achieved. This combination of development properties is not achieved when the development is effected first with a following roller and subsequently with a counterrunning roller. Moreover, magnetizable particles such as iron particles of a binary developing powder are then transferred to the charge image, with the consequences that a photoconductive substrate carrying images to be developed is quickly damaged and that, if the toner is transferred electrically to the charge image, toner is no longer transferred where the iron particles exist and a copy is obtained with white spots in its image parts.

Although a developing apparatus having a counterrunning first developing roller and a following second developing roller is known from British patent specification No. 1,158,209, that apparatus makes use of external magnets by which magnetizable material is attracted to the developed image, and this magnetizable material is removed subsequently by additional magnets. This leads to an accelerated ageing of the magnetizable material, and moreover the optical density again becomes lower. Further, a sloped transport belt immersed in the powder is used for transporting the developing powder, which belt causes friction with the developing powder in the reservoir and consequently reduces the service life of the powder. The developing powder is also not mixed sufficiently, there being no mixing device in the reservoir.

The present invention will be further understood from the following description and the accompanying drawings of an illustrative embodiment. In the drawings.

Figure 1:
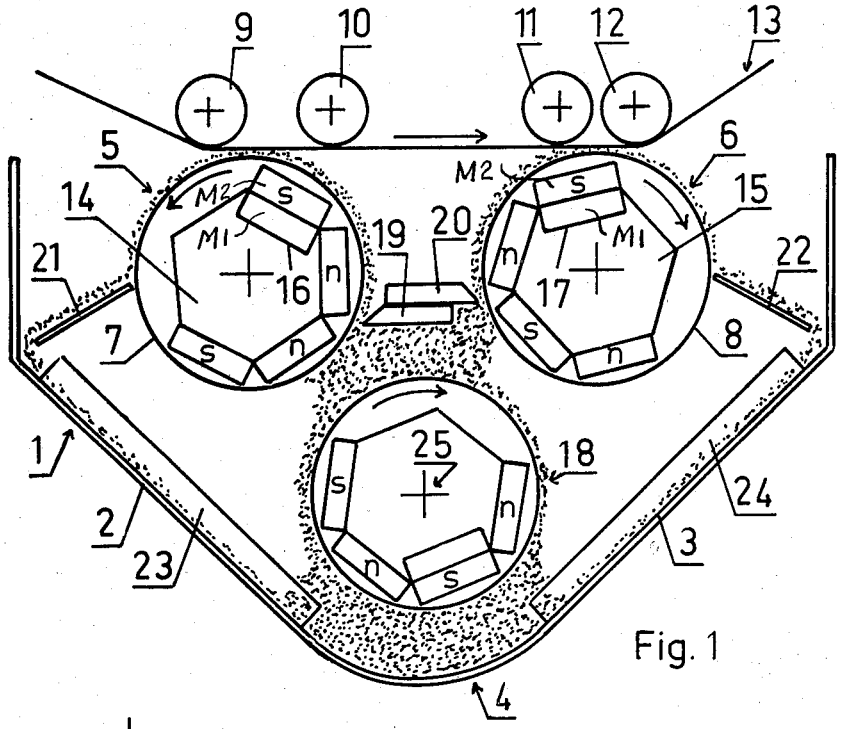
FIG. 1 is a schematic cross-sectional view of a developing apparatus embodying the invention, taken along a line indicated at I—I in FIG. 2, perpendicular to the axes of the developing rollers.
Figure 2:
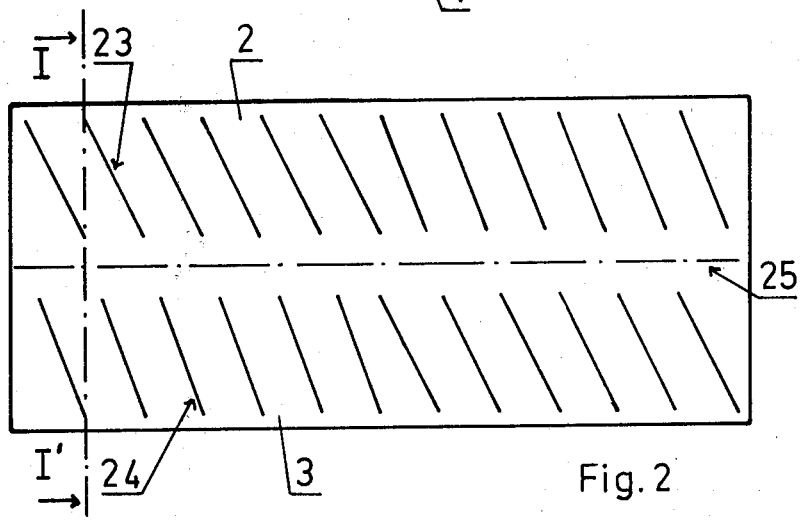
FIG. 2 is a schematic developed plan view at a reduced scale of the sloping side walls and bottom of the same developing apparatus.

The developing apparatus according to FIGS. 1 and 2 comprises a trough-shaped reservoir 1 having two oppositely disposed sloping walls 2 and 3 which lie in planes merging with the bottom portion 4 of the reservoir. A first developing roller 5 and a second developing roller 6 are mounted in the upper region of the reservoir with their axes parallel to each other and parallel to the line of intersection that would be formed by downward extensions of the sloping walls.

Each of the developing rollers 5 and 6 comprises a hollow non-magnetizable metal cylinder 7 or 8 which is rotatable in the direction of the respective arrow. When the apparatus is operating, the cylinders of the developing rollers rotate away from each other at their side directed toward the image substrate to be developed, i.e., at the side directed away from the bottom of the reservoir. At that side and near the developing rollers respective pairs of guide rollers 9, 10 and 11, 12 are provided for guiding in a path of movement past the developing rollers a photoconductive belt 13 which carries the charge images to be developed.

The non-magnetizable cylinder 7 or 8 of each developing roller rotates about a stationary magnet system inside the cylinder, which system comprises a core 14 or 15 of soft iron having a hexagonal cross section. Each core is formed over its full length, in a side thereof directed toward the photoconductive belt 13, with a recess 16 or 17 in which a magnet strip M1 is mounted. Each magnet strip M1 has a second magnet strip M2 fixed thereto as an outer layer. The magnet strips M2 have the same polarity at their outer sides directed toward the surface of the photoconductive belt; thus, ordinarily, each of them has a south pole along its outer side.

The core 14 in the first developing roller 5 is provided on its three sides which follow the recessed side thereof, as viewed in the direction counter to the direction of rotation of the cylinder 7, with magnet strips having outwardly directed north, north and south poles, respectively. The core 15 in the second developing roller 6 is provided on its three sides which follow its recessed side, as viewed in the direction counter to the direction of rotation of the cylinder 8, with magnet strips having outwardly directed north, south and north poles, respectively. In FIG. 1, S indicates a magnet having an outwardly directed south pole and N indicates a magnet having an outwardly directed north pole.

A transport roller 18 is provided in a region of the reservoir 1 below the developing rollers 5 and 6, with its axis 25 parallel to the axes of the developing rollers. This transport roller comprises, in substantially the same manner as the two developing rollers, a non-magnetizable cylinder rotatable about a stationary magnet system comprising a soft iron core of hexagonal cross section provided with magnet strips along four successive sides of the core. The two magnet-free sides of the core of the transport roller 18 are directed toward the developing rollers. The sides provided with magnet strips are directed toward the sloping side walls 2 and 3 and the bottom of the reservoir, and these magnet strips alternately present north and south magnetic poles directed outwardly. The cylinder of the transport roller 18 rotates in the same direction as the cylinder of the second developing roller 6 and oppositely to the cylinder of the first developing roller 5, as indicated by the arrows.

The transport roller 18 transports developing powder from the bottom region of the reservoir 1 to the space between the two developing rollers, where the developing powder is picked up by the magnetic fields of the developing rollers. Scrapers 19 and 20 are mounted in this space near the developing rollers so that each scraper extends over the whole axial length of the surface of the cylinder of a developing roller and limits the thickness of the layer of developing powder carried on the developing roller.

At the side of each developing roller opposite to its scraper 19 or 20, a plate-shaped scraper 21 or 22 extends over the whole axial length of the surface of the pertaining developing roller cylinder and extends away from this surface downwardly toward an upper portion of the nearest sloping side wall 2 or 3. Developing powder that is carried by the developing rollers toward the sloping walls after passing the photoconductive belt 13 is removed from the developing rollers by the scrapers 21 and 22 and is delivered downward via these scrapers so as to fall from them onto upper regions of the inner surfaces of the sloping side walls, whereupon this returned powder passes down over the sloping walls to rejoin the supply of developing powder in the reservoir.

Each of the sloping walls 2 and 3 is provided with a group of parallel partitions 23 or 24, which protrude perpendicularly from the sloping walls and extend from their upper regions to the bottom region of the reservoir. All the partitions 23 on sloping wall 2 are inclined at an acute angle to the axis 25 of the transport roller, which is parallel to the center line represented in FIG. 2, and thus to the axes of the developing rollers. Considered in the same direction, all the partitions 24 on the other sloping wall 3 are inclined at an obtuse angle to the axis 25 of the transport roller and the axes of the developing rollers. As a result, the developing powder that falls downward from the scrapers 21 and 22 is deflected from the normal direction of fall into directions toward the ends of the trough-shaped reservoir. The deflection on one sloping wall is toward one end of the reservoir and the deflection on the other sloping wall is toward the other end thereof.

When all partitions of a group 23 or 24 are installed parallel to each other, the developing powder may sometimes accumulate objectionably at one end of the reservoir, for instance if the reservoir is not quite horizontal as installed for use. In order to avoid this, the partitions on each sloping wall in preferred embodiments of the invention are divided into two subgroups in such manner that, viewed in the same direction, each partition of a first subgroup has a smaller acute angle, respectively smaller obtuse angle, relative to the axes of the transport roller and the developing rollers than the partitions of the second subgroup.

In the arrangement illustrated in FIG. 2, which schematically represents the sloping walls as developed to a horizontal surface, the partitions of the first subgroup of one sloping wall lie for example at an angle of 66° to the axis of the transport roller, and the partitions of the second subgroup on the same wall lie for example at an angle of 73° to the axis of the transport roller. On the other sloping wall, viewed in the same direction, the angles which the partitions of the first and second subgroups make with the axis of the transport roller are for example 107° and 114°, respectively. With this arrangement, a slight accumulation of developing powder may occur at the center of the reservoir but this does not cause trouble.

The indicated relationships of angles enable an optimal mixing of developing powder in the reservoir. In the use of a developing unit having a length of 21 cm, they have enabled differences of powder concentration to be eliminated within 30 seconds. For this test 2% of developing powder, calculated on the weight of iron powder in the reservoir, was added into one end of a reservoir which contained iron powder only. The particular angles above indicated, however, are not critical as a good mixing is also obtained when the acute angles are varied at values between 50° and 80° and the obtuse angles are varied at values between 100° and 130°.

In the developing apparatus described above the first developing roller 5 is provided with two north poles beside each other. In an alternate embodiment, the order south-north-south-north for the locations of the outwardly directed magnet poles can be employed in the developing roller corresponding to roller 5, but in that case, when developing with a binary toner with the simultaneous application of a high bias voltage between the photoconductive belt and the first developing roller, a layer of toner may be transferred electrostatically to the cylinder of the developing roller. This may cause the developing current and consequently the optical density of the developed image to start decreasing. When two like poles are located beside each other adjacent to the zone between the developing rollers where developing powder is being supplied, a toner layer formed on the first developing roller is wiped away from it by the developing powder supplied between the developing rollers. It appears superfluous to provide two like poles beside each other in the second developing roller 6, possibly because any layer of toner formed on that roller is automatically wiped away from it due to its surface moving oppositely to the surface of the transport roller 18 in the space between rollers 6 and 18.

The elimination of any toner layer formed on the developing rollers can also be effected, according to another alternative embodiment of the invention, by employing in the reservoir below these rollers, instead of a single transport roller, two smaller transport rollers located near the respective developing rollers and each rotatable in the direction opposite to the pertaining developing roller.

What is claimed is:

1. In an apparatus for magnetic brush development of electrostatic charge images on a moving substrate, comprising a trough-shaped reservoir having two oppositely disposed elongate side walls sloping into the reservoir bottom, a plurality of developing rollers in an upper region of said reservoir and lying parallel to said walls, each of which rollers comprises a non-magnetizable cylinder rotatable about stationary magnets inside the cylinder, means between the bottom of the reservoir and the developing rollers for transporting developing powder to said rollers, and means for mixing with powder in the reservoir developing powder returned into the reservoir from said rollers, the improvement comprising that (a) the developing rollers are constituted by two said developing rollers each of which is located outside the other's sphere of influence and the respective cylinders of these rollers have opposite directions of rotation so that their surfaces at the side thereof toward said substrate move away from each other;

(b) said powder transporting means comprises at least one non-magnetizable cylinder lying parallel to said developing rollers and rotatable about stationary magnets inside the cylinder for supplying developing powder from a bottom region of the reservoir to a region thereof between said developing rollers; and (c) said mixing means comprises oppositely disposed groups of parallelly erect partitions fixed to said sloping walls with the partitions on one of said walls lying in planes at acute angles to the axes of the developing rollers and the partitions on the other of said walls, viewed in the same direction, lying in planes at obtuse angles to said axes.

2. Apparatus according to claim 1, each of said groups of partitions comprising first and second subgroups of partitions, the first subgroup of partitions on said one wall lying at a smaller acute angle to said axes than the second subgroup thereon, and the first subgroup of partitions on said other wall lying at a smaller obtuse angle to said axes than the second subgroup on said other wall.

3. Apparatus according to claim 1, said partitions on said one wall lying at angles of between 50° and 80° to said axes and said partitions on said other wall lying at angles of between 100° and 130° to said axes.

4. Apparatus according to claim 1, each of said developing rollers comprising inside its said cylinder a soft iron core of substantially hexagonal cross section having permanent magnets in strip form fixed to and along sides of the core.

5. Apparatus according to claim 4, each said core having a recess formed in and along a side thereof directed toward said substrate, each said recess having a strip magnet fixed therein and overlaid by a second strip magnet, the respective second strip magnets of said developing rollers being of the same polarity along their outer sides.

6. Apparatus according to claim 4, said transporting means being constituted by one said non-magnetizable cylinder lying parallel to, below and between said developing rollers and rotatable about stationary magnets inside said one cylinder, the respective surfaces of said one cylinder and the cylinder of a first of said developing rollers moving in the same direction through the space between them, said first developing roller having on two adjacent sides of its said core which lie adjacent to said space strip magnets having the same polarity along their outer sides.

7. In an apparatus for magnetic brush development of electrostatic charge images on a moving substrate, comprising a trough-shaped reservoir having two oppositely disposed elongate side walls sloping into the reservoir bottom, a plurality of developing rollers in an upper region of said reservoir and lying parallel to said walls, each of which rollers comprises a non-magnetizable cylinder rotatable about stationary magnets inside the cylinder, means between the bottom of the reservoir and the developing rollers for transporting developing powder to said rollers, and means for mixing with powder in the reservoir developing powder returned into the reservoir from said rollers, the improvement comprising that (a) the developing rollers are constituted by two said developing rollers each of which is located outside the other's sphere of influence and the respective cylinders of these rollers have opposite directions of rotation so that their surfaces at the side thereof toward said substrate move away from each other, each of said developing rollers comprising inside its said cylinder a soft iron core of substantially hexagonal cross section having permanent magnets in strip form fixed to and along sides of the core, each said core having a recess formed in and along a side thereof directed toward said substrate, each said recess having a strip magnet fixed therein and overlaid by a second strip magnet, the respective second strip magnets of said developing rollers being of the same polarity along their outer sides;

(b) said powder transporting means comprises at least one non-magnetizable cylinder lying parallel to said developing rollers and rotatable about stationary magnets inside the cylinder for supplying developing powder from a bottom region of the reservoir to a region thereof between said developing rollers; and (c) said mixing means comprises oppositely disposed groups of parallelly erect partitions fixed to said sloping walls with the partitions on one of said walls lying in planes at acute angles of between 50° and 80° to the axes of the developing rollers and the partitions on the other of said walls, viewed in the same direction, lying in planes at obtuse angles of between 100° and 130° to said axes.

8. Apparatus according to claim 7, each of said groups of partitions comprising first and second subgroups of partitions, the first subgroup of partitions on said one wall lying at a smaller acute angle to said axes than the second subgroup thereon, and the first subgroup of partitions on said other wall lying at a smaller obtuse angle to said axes than the second subgroup on said other wall.

9. Apparatus according to claim 7 or claim 8, said transporting means being constituted by one said non-magnetizable cylinder lying parallel to, below and between said developing rollers and rotatable about stationary magnets inside said one cylinder, the respective surfaces of said one cylinder and the cylinder of a first of said developing rollers moving in the same direction through the space between them, said first developing roller having on two adjacent sides of its said core which lie adjacent to said space strip magnets having the same polarity along their outer sides.

* * * * *